United States Patent [19]

Beezhold et al.

[11] Patent Number: 5,034,594

[45] Date of Patent: Jul. 23, 1991

[54] PORTABLE ELECTRICALLY HEATED SEAT CUSHION

[76] Inventors: Frank L. Beezhold, 9216 12th Ave. Northwest, Seattle, Wash. 98117; Cheri A. Ranes; Jeffrey B. Ranes, both of 1814 Owen Cir., Montesano, Wash. 98563

[21] Appl. No.: 391,340

[22] Filed: Aug. 9, 1989

[51] Int. Cl.[5] ..... H05B 3/34

[52] U.S. Cl. ..... 219/528; 219/217; 219/533; 5/466

[58] Field of Search ..... 219/217, 528, 529, 549, 219/211, 387, 533; 206/333; 320/2; 5/466, 467

[56] References Cited

U.S. PATENT DOCUMENTS

| | | | |
|---|---|---|---|
| 1,153,718 | 9/1915 | Silverthorn | 5/466 |
| 2,021,238 | 11/1935 | Karr | 5/466 |
| 2,355,200 | 8/1944 | Bechik | 5/467 |
| 2,500,336 | 3/1950 | Bechik | 5/467 |
| 3,014,117 | 12/1961 | Madding | 219/217 |
| 3,108,596 | 10/1963 | Veach | 219/527 |
| 3,380,087 | 4/1968 | Petty | 219/217 |
| 3,427,431 | 2/1969 | Costanzo | 219/212 |
| 3,500,014 | 3/1970 | Longo | 219/211 |
| 3,621,192 | 11/1971 | Pohler | 219/217 |
| 3,973,179 | 8/1976 | Weber | 320/2 |
| 4,035,606 | 7/1977 | Browder | 219/211 |
| 4,095,090 | 6/1978 | Pianezza | 320/2 |
| 4,279,255 | 7/1981 | Hoffman | 128/402 |

FOREIGN PATENT DOCUMENTS

| | | | |
|---|---|---|---|
| 576366 | 5/1959 | Canada | 219/217 |
| 1031119 | 6/1953 | France | 219/528 |
| 176966 | 5/1935 | Switzerland | 5/466 |
| 394513 | 6/1933 | United Kingdom | 5/466 |

*Primary Examiner*—Teresa J. Walberg

*Attorney, Agent, or Firm*—Robert W. Beach; Ward Brown

[57] ABSTRACT

A seat cushion heated by an electrical resistance heating element sandwiched between two seat cushion sections is covered by a flexible sheet cover integral with two web projections projecting from an edge of the cushion and spaced apart lengthwise of such cushion edge a distance for reception of a hand therebetween, and a battery housing tube elongated lengthwise of such cushion edge arranged substantially parallel thereto, having ears projecting from the side of the battery housing tube nearer the cushion, spaced apart lengthwise of the tube a distance corresponding to the spacing of the web projections and secured to the web projections, a cap for closing one end of the battery housing tube and openable for insertion of a battery into the housing tube and the other end of the housing tube being closed by a cover including a rotary switch for energizing the electrical resistance heating element by a battery in the battery housing tube.

10 Claims, 1 Drawing Sheet

PORTABLE ELECTRICALLY HEATED SEAT CUSHION

BACKGROUND OF THE INVENTION

1. Field of the Invention

The present invention relates to an electrically heated seat cushion and particularly to such a seat cushion which is readily portable.

2. Prior Art

The Longo U.S. Pat. No. 3,500,014, issued Mar. 10, 1970, states at column 1, lines 28 to 32 that electrical resistance wires have been used to heat various types of articles for warming the human body, including blankets, heating pads, jackets and pants.

The Costanzo U.S. Pat. No. 3,427,431, issued Feb. 11, 1969, discloses the use of two low voltage batteries connected in series to generate the voltage required for energizing an electrical resistance heater for a sleeping bag.

The Hoffman U.S. Pat. No. 4,279,255, issued July 21, 1981, discloses utilization of a battery pack including two "D" two-volt lead acid rechargeable batteries having a combined voltage of four volts for heating an electrical resistance heater that could be applied to various parts of the body.

The Browder U.S. Pat. No. 4,035,606 issued July 12, 1977, discloses a cushion that is heated by electrical resistance wire heating elements, as stated at column 2, lines 14 to 16, and a carrying case for the cushion.

SUMMARY OF THE INVENTION

The principal object of the present invention is to provide a seat cushion heated by electrical resistance heating that is readily and conveniently portable.

A further object is to provide a heated seat cushion which is economical to make and rugged, in which batteries can be replaced readily, and which can be stored easily when not in use.

Another object is to provide a convenient grip or handle for carrying a seat cushion which may serve as a housing for batteries to supply electric current to an electrical resistance heating unit for the seat cushion.

The foregoing objects can be accomplished by a seat cushion heated by an electrical resistance heating unit, which seat cushion is closely connected to a housing for batteries, which housing serves as a grip by which the heated cushion can be carried.

DETAILED DESCRIPTION

Figure 1:
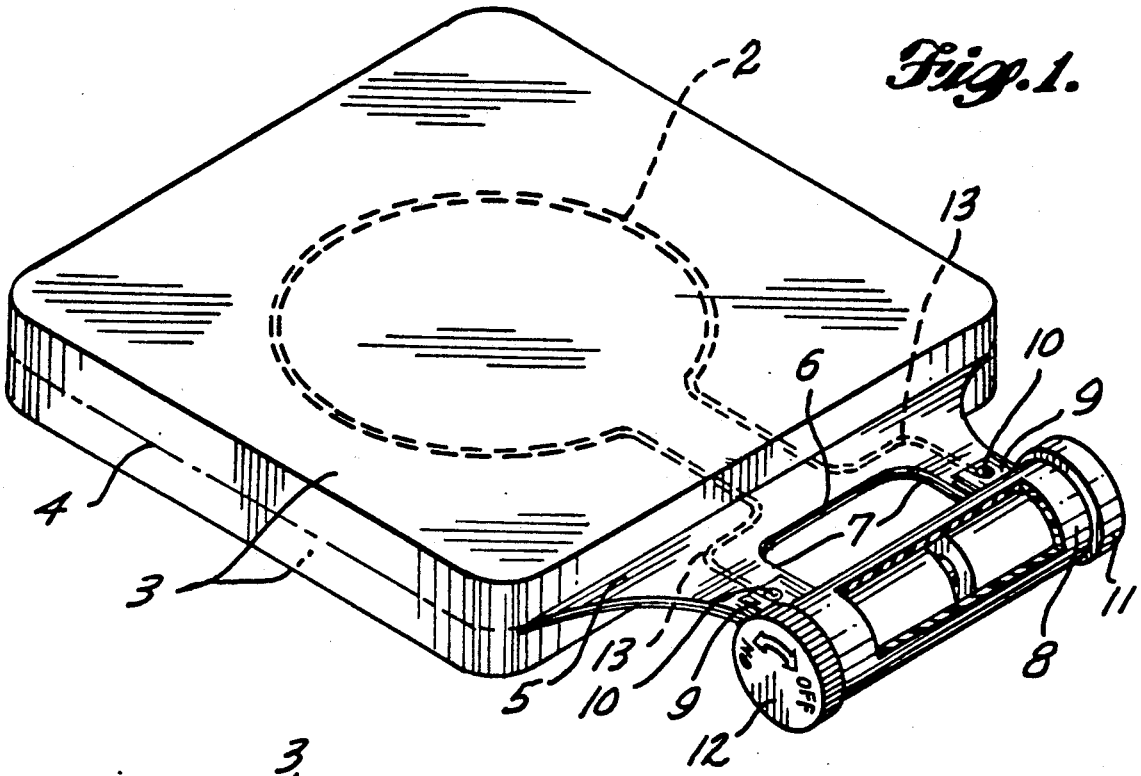
FIG. 1 is a top perspective of the seat cushion and grip with parts broken away and FIG. 2 is a plan of such seat cushion and grip with parts broken away.

The seat cushion can conveniently be composed of two resilient elastomer foam cushion sections 1, each ¾ inch to one inch (2 cm. to 2½ cm.) in thickness and each substantially square, having a width of fourteen inches (35 cm.) to sixteen inches (40 cm.) placed in registration with a conventional electrical resistance heating unit 2 sandwiched between them. The sandwich formed by the cushion sections 1 and the resistance heating unit 2 between them is closely covered by a flexible sheet cover 3, such as of vinyl. Such cover can be conveniently made in two halves or made from a single doubled sheet. In either case, the meeting edges of the sheet portions at the opposite sides of the cushion sandwich can be joined by a heatsealed seam 4.

The sheet portions covering opposite sides of the cushion sandwich have flexible projections projecting from one edge of the cushion in overlapping relationship constituting a web 5. Such web has an aperture 6 in its central portion of an extent lengthwise of the adjacent cushion edge to receive a hand through it. Such aperture defines two projections 7 spaced apart lengthwise of the adjacent cushion edge a distance for reception of a hand therebetween, that are arranged symmetrically about the center of such cushion edge and connected to longitudinally spaced portions of an elongated tube 8 providing a battery housing.

Figure 2:
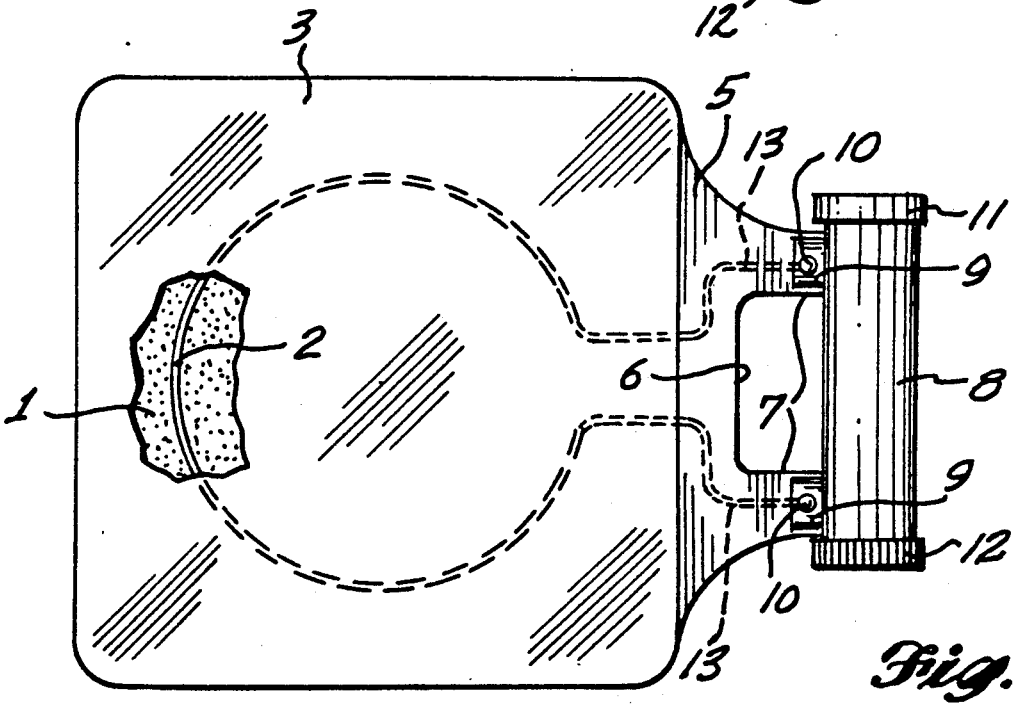
Figure 3:
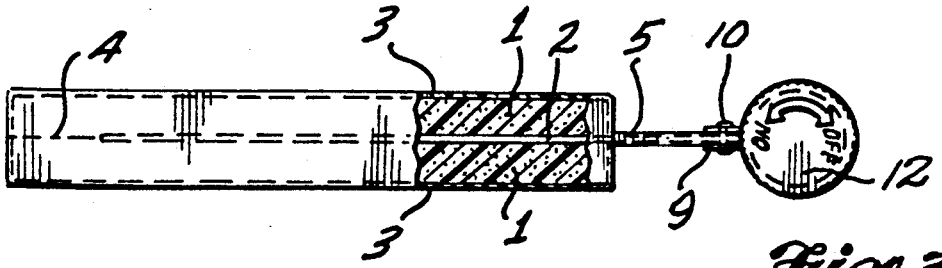
FIG. 3 is an edge elevation of the seat cushion and grip with parts broken away.

The battery housing tube 8 preferably is cylindrical, is of a length to accommodate two "D" cells in its interior and has an exterior of a size to function as a convenient grip for carrying the cushion. As shown best in FIG. 2, ears 9 may project from one side of the battery housing toward one edge of the cushion component. As shown in FIG. 3, each of these ears preferably is bifurcated to function as a clevis embracing the projections 7 from the seat cushion unit which are spaced apart correspondingly when the tube 8 is located alongside and parallel to such edge of the cushion component. The tube 8 is of a length equal to at least a major portion of the length of such cushion component edge. The leaves of the ears 9 can be secured together to clamp the sheet material of the cushion cover between them by rivets 10. Because of the flexible character of the web 5 and projections 7, the battery housing tube 8 can fall down of the plane of the housing to dispose the battery housing tube below the edge of the cushion so as to be out of the way of a person sitting on the cushion.

One end of the battery housing 8 is closed by a screw cap 11 which may be removed for access to the interior of the housing for placement of batteries in the tube 8 or removal of batteries from it. The opposite end of the housing is closed by a cover that can be mounted permanently on the tube but which can be turned relative to the tube at least sufficiently to operate an on-off switch carried by the cover and which controls the electrical circuit between the batteries in the battery housing tube and the electrical resistance heating unit 2 sandwiched between the cushion sections 1.

The electrical resistance heating element 2 is connected to the power circuit in the battery housing tube by flexible leads 13 extending through the projections 7 from the cushion sandwich casing.

I claim:

1. An electrically heated seat cushion comprising a seat cushion having a heating unit therein and two flexible projections projecting from an edge of said cushion spaced apart lengthwise of said cushion edge a distance for reception of a hand therebetween and arranged symmetrically about the longitudinal center of said cushion edge, and a battery housing tube elongated lengthwise of said cushion edge, arranged substantially parallel thereto, substantially centered longitudinally with respect to said cushion edge and connected to said spaced cushion edge projections for serving as a grip.

2. The electrically heated seat cushion defined in claim 1, the cushion edge projections being web projections, the battery housing tube having ears projecting from the side thereof nearer the cushion and spaced apart lengthwise of the housing a distance corresponding to the spacing of said web projections and the battery housing being connected to the cushion edge by said web projections being secured to said ears, respectively.

3. The electrically heated seat cushion defined in claim 2, in which the flexible web projections are disposed substantially coplanar.

4. The electrically heated seat cushion defined in claim 2, including a flexible plastic sheet cover covering the seat cushion and being integral with flexible web projections.

5. The electrically heated seat cushion defined in claim 1, in which the seat cushion includes two seat cushion sections arranged in registration and an electrical resistance heating unit sandwiched between said two cushion sections.

6. A seat cushion assembly comprising a seat cushion having two flexible projections projecting from an edge thereof spaced apart lengthwise of said cushion edge a distance for reception of a hand therebetween and arranged symmetrically about the longitudinal center of said cushion edge, and a tube elongated lengthwise of said cushion edge, arranged substantially parallel thereto, substantially centered longitudinally with respect to said cushion edge and connected to said spaced cushion edge projections for serving as a grip.

7. The seat cushion assembly defined in claim 6, the cushion edge projections being flexible web projections, the tube being of a length equal to at least a major portion of the length of such cushion edge and having ears projecting from the side thereof nearer the cushion spaced apart lengthwise of the tube a distance corresponding to the spacing of said web projections, and the tube being connected to the cushion edge by said web projections being secured to said ears, respectively.

8. The seat cushion assembly defined in claim 7, in which the flexible web projections are flat and disposed substantially coplanar.

9. The seat cushion assembly defined in claim 7, including a flexible plastic sheet cover covering the seat cushion and being integral with the flexible web projections.

10. An electrically heated seat cushion comprising a seat cushion having a heating unit therein and two projections projecting from an edge of said cushion spaced apart lengthwise of said cushion edge a distance for reception of a hand therebetween, and a battery housing tube elongated lengthwise of said cushion edge, arranged substantially parallel thereto and connected to said cushion edge for serving as a grip and having a cap for closing one end openable for reception of a battery in said tube, and a rotary switch cover closing the other end of said battery housing tube.

* * * * *